United States Patent [19]

Reed

[11] Patent Number: 4,995,603

[45] Date of Patent: Feb. 26, 1991

[54] AMUSEMENT SYSTEM INCLUDING RIDING CAPSULE DEVICE

[76] Inventor: Victoria K. Reed, 1778 Peck La., Cheshire, Conn. 06410

[21] Appl. No.: 437,753

[22] Filed: Nov. 17, 1989

Related U.S. Application Data

[63] Continuation-in-part of Ser. No. 922,942, Oct. 24, 1986.

[51] Int. Cl.[5] ..... A63G 31/02

[52] U.S. Cl. ..... 272/18; 272/17; 272/35; 272/46

[58] Field of Search ..... 272/17-19, 272/33 A, 35

[56] References Cited

U.S. PATENT DOCUMENTS

| | | | |
|---|---|---|---|
| 3,477,713 | 11/1969 | Cudmore | 272/33 A |
| 3,720,007 | 3/1973 | McKechnie et al. | 272/17 |
| 4,461,470 | 7/1984 | Astroth et al. | 272/17 |
| 4,478,407 | 10/1984 | Manabe | 272/18 |

*Primary Examiner*—Richard E. Chilcot, Jr.
*Attorney, Agent, or Firm*—CTC & Associates

[57] ABSTRACT

An amusement system includes a riding capsule member and a base member. The capsule member engages the base member and is rotatable and tiltable with respect thereto. The system also includes a video screen and means for displaying scenes thereon, such as displays of outer space, whereby visual stimuli are provided to an occupant of the capsule member and the capsule member is rotatable and tiltable as the visual stimuli are observed. The capsule member may contain a cassette player or the like for providing audible stimuli in enhancement of the visual stimuli. The system may also include a computer. The rotating and tilting action will occur in a free rolling mode, as the occupant watches the video screen.

6 Claims, 1 Drawing Sheet

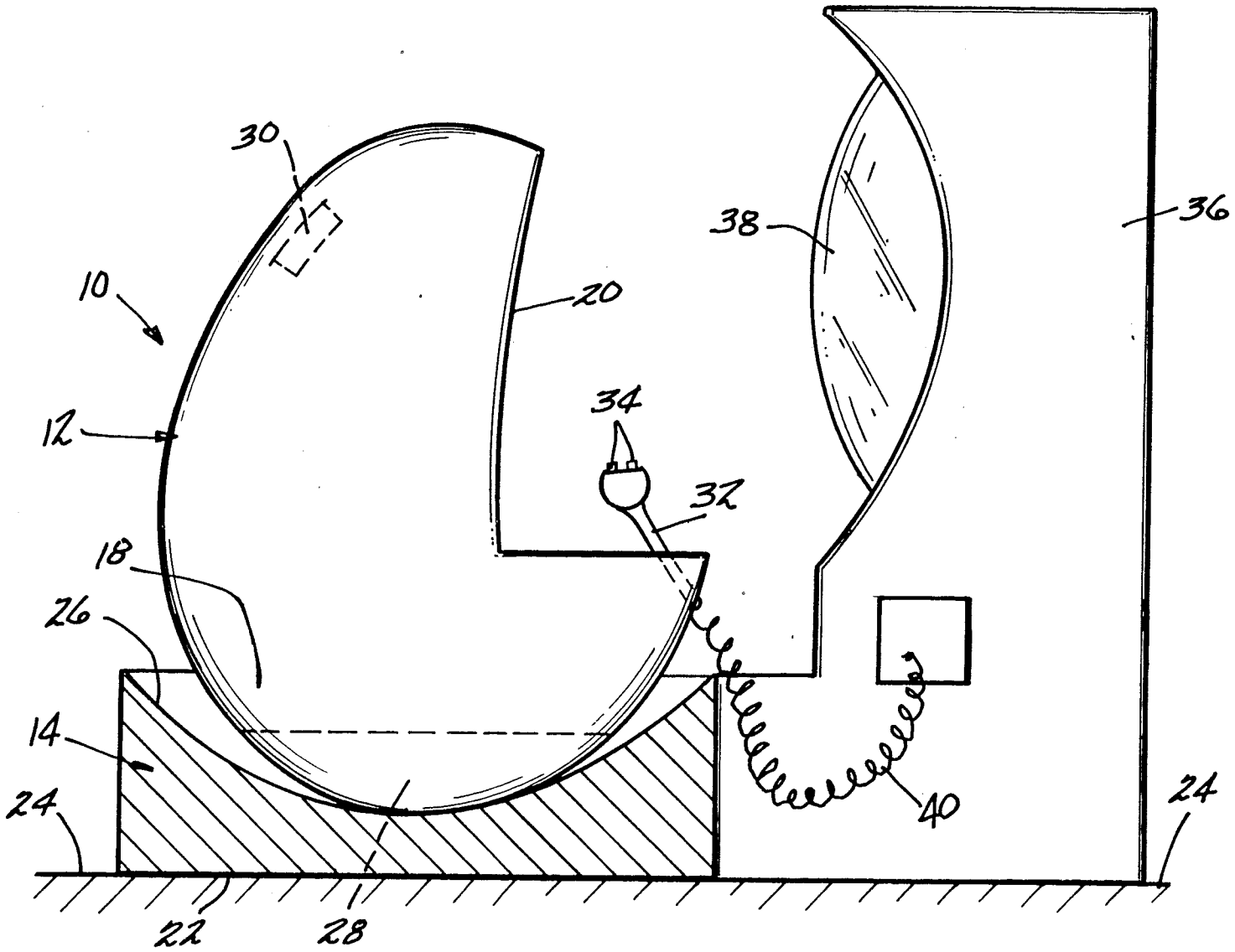
36
24
38
40
32
34
20
30
10
12
18
26
14
24
28
22

AMUSEMENT SYSTEM INCLUDING RIDING CAPSULE DEVICE

RELATED APPLICATION

This application is a continuation-in-part of copending Application Ser. No. 922,942 filed Oct. 24, 1986.

BACKGROUNDD AND SUMMARY OF THE INVENTION

The present invention relates to an amusement system including a riding capsule device.

The copending application discloses a riding capsule device which includes a capsule member having a generally eggshaped body with a convex exterior shape having a bottom configuration in the form of a convex spherical segment. The riding capsule device of the copending application also has a base member with a flat bottom surface for stationary placement on a horizontal surface and a top configuration in the form of a concave spherical segment having a radius of curvature which is larger than the radius of curvature of the convex spherical segment. The spherical segments engage each other so that in use the capsule member can tilt and rotate with respect to the base member, under the impetus of an occupant of the capsule member, while confined thereby to a limited horizontal location.

The present invention provides an amusement system including a riding capsule device as described above and means for displaying visual stimuli and/or audible stimuli such as theme music to enhance the visual stimuli. The visual stimuli may be displays of outer space, such as planets, comets, moons, space stations, etc.

The capsule member may be operated in a free rolling mode, in which the rolling and tilting action imported to it will be solely the result of either voluntary or involuntary (or both) reactions of an occupant to what is seen and/or heard.

It is an important object of the invention to provide an amusement system including a riding capsule device as described and means for displaying visual stimuli and/or audible stimuli to enhance the visual stimuli.

It is another object of the invention to provide such a system in which the riding capsule device can be operated in a free rolling mode.

DESCRIPTION OF THE DRAWING

The single figure shows, somewhat schematically, an amusement system embodying the invention.

DESCRIPTION OF THE INVENTION

The drawing shows a riding capsule device 10 including a capsule member 12 and a base member 14.

Capsule member 12 is generally egg-shaped and has a convex exterior configuration including a bottom configuration in the form of a convex spherical segment 18 of predetermined radius of curvature. Member 12 also has a cut-out portion 20 in its wall, whereby a person can enter or leave capsule member 12 and while therein can see out over a fairly wide angular range.

Base member 14 has a flat bottom surface 22 which is shown resting on a horizontal surface such as a floor 24. Base member 14 also has a top configuration in the form of a concave spherical segment 26 of predetermined radius of curvature that is greater than the predetermined radius of curvature of convex spherical segment 18. Convex spherical segment 18 is in engagement with concave spherical segment 26, and by virture of such engagement, capsule member 12 can tilt and rotate with respect to base member 14.

The bottom portion of capsule member 12 may be weighted as indicated at 28, for stability, and the interior of capsule member 12 is shaped to accommodate a human occupant or user.

The interior of capsule member 12 is also provided, as an element of the inventive system, with a cassette player 30 or the like to play outer space music, such as "2001 Space Odyssey" or Beethoven's Ninth Symphony, or the like.

The interior of capsule member 12 also has a control lever or joy stick 32 having control means such as buttons 34 on the end thereof which serves as a steering mechanism in that it changes the display on the screen described below giving the rider the illusion of traveling through outer space and while watching the video screen the rider involuntarily moves and causes capsule member 12 to roll.

The inventive system also includes a stand or console 36 mounted on floor 24 and having a video screen 38 visible to an occupant of capsule member 12. Console 36 also includes therein known electronic equipment (not shown) for displaying on screen 38 outer space scenes such as planets, comets, moons, space stations, etc. If used, the audible stimuli supplied by cassette player 30 are an appropriate accompaniment to the outer space scenes displayed on screen 38 and give the capsule occupant the illusion of traveling through outer space. Capsule member 12 may be operated in a free rolling mode or an occupant controlled mode, in which the rolling and tilting action imparted to it will be solely the result of either voluntary or involuntary (or both) reactions of an occupant to what is seen and/or heard.

The invention also may include a computer C contained in console 36 and connected by wires 40 to control lever or joy stick 32. Computer C is programmed to show a video display of outer space, giving the occupant of capsule device 10 the ability to simulate changing directions of travel by altering the perspective of the view on the screen.

It is apparent that the invention attains the stated objects and advantages and others.

The disclosed details are exemplary only and are not to be taken as limitations on the invention except as those details may be included in the appended claims.

What is claimed is:

1. An amusement system comprising a riding capsule device including a capsule member and a base member, said capsule member engaging said base member, a video screen visible to an occupant of said capsule member and means for displaying scenes on said screen, whereby visual stimuli are provided to the occupant and said capsule member is rotatable and tiltable with respect to said base member as said stimuli are observed, wherein said capsule is rotatable and tiltable in a free rolling mode in which the motion of said capsule member will be solely the result of reactions of the occupant to observed stimuli.

2. An amusement system according to claim 1 further comprising means within said capsule member for providing audible stimuli to the occupant to enhance the visual stimuli.

3. An amusement system according to claim 1 wherein said system further comprises a computer and means for activating said computer to modify the program's view to cause the occupant to have the illusion of steering himself/herself through outer space and control means enabling the occupant to control the scenes displayed on said screen.

4. An amusement system according to claim 1 further comprising a console in which said video screen is located.

5. An amusement system according to claim 4 further comprising a console in which said video screen and said computer are located.

6. An amusement system according to claim 3 wherein said control means includes a control lever and said computer is connected by wires to said control lever.

* * * * *